US005552864A

United States Patent [19]

Malicki et al.

[11] Patent Number: 5,552,864

[45] Date of Patent: Sep. 3, 1996

[54] MAGNETIC SEAL WITH TAPERED SHUNTS

[75] Inventors: Jan M. Malicki; David B. Playfair, both of Rochester; Steven C. Hart, Webster, all of N.Y.

[73] Assignee: Xerox Corporation, Stamford, Conn.

[21] Appl. No.: 373,717

[22] Filed: Jan. 17, 1995

[51] Int. Cl.[6] ..... G03G 21/00; G03G 15/06

[52] U.S. Cl. ..... 355/215; 355/245

[58] Field of Search ..... 355/215, 245, 355/251, 253; 118/656–658; 277/12, 80

[56] References Cited

U.S. PATENT DOCUMENTS

| | | | |
|---|---|---|---|
| 3,788,275 | 1/1974 | Hanson | 118/637 |
| 4,040,386 | 8/1977 | Smith | 118/653 |
| 4,596,455 | 6/1986 | Kohyama et al. | 118/656 X |
| 4,616,919 | 10/1986 | Adley et al. | 355/245 |
| 4,878,088 | 10/1989 | Nakanishi et al. | 355/244 |
| 5,177,536 | 1/1993 | Watanabe et al. | 355/251 |
| 5,187,328 | 2/1993 | Shirai | 118/657 |
| 5,267,007 | 11/1993 | Watanabe et al. | 355/245 |
| 5,287,148 | 2/1994 | Sakemi et al. | 355/245 |
| 5,442,423 | 8/1995 | Edmunds et al. | 355/215 |
| 5,450,169 | 9/1995 | Hart et al. | 355/215 |

FOREIGN PATENT DOCUMENTS

| | | | |
|---|---|---|---|
| 63-124075 | 5/1988 | Japan | 355/251 |

*Primary Examiner*—William J. Royer
*Attorney, Agent, or Firm*—John S. Wagley

[57] ABSTRACT

A system for sealing a member rotating about an axis of a support is provided. The system includes a magnetic field producing member and a magnetizable member. The magnetizable member is positioned adjacent the magnetic member. The magnetizable member has at least a portion thereof progressively increasing in thickness in a direction substantially parallel to the axis as distance from the axis increases.

27 Claims, 6 Drawing Sheets

MAGNETIC SEAL WITH TAPERED SHUNTS

The present invention relates to a developer apparatus for electrophotographic printing. More specifically, the invention relates to a seal for sealing journals within a development system.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways, In the process of electrophotographic printing, the step of conveying toner to the latent image on the photoreceptor is known as "development."0 The object of effective development of a latent image on the photoreceptor is to convey developer material to the latent image at a controlled rate so that the developer material effectively adheres electrostatically to the charged areas on the latent image. At a development station, a development system or developer unit develops the latent image recorded on the photoconductive surface. A chamber in a developer housing stores a supply of developer material. To convey the developer material in the chamber to the latent image and to mix and triboelectrically charge the developer, a series of augers and magnetic rollers are strategically placed in the chamber and supported by the developer housing. Since these augers and rollers rotate, bearings are used to support the rollers at the housing.

A typical prior art developer bearing arrangement is shown in FIG. 2. An apparatus 10 for sealing a shaft or journal 16 includes a magnetic seal 11 which is located inboard from a bearing 12. The bearing 12 is typically a sealed ball bearing having lip seal on both sides thereof. The shaft 16 extends inwardly into the chamber formed by a developer housing 15. The chamber contains developer material. The shaft 16 extends through an opening in the developer housing 15. The magnetic seal 11 is located in the opening adjacent the chamber. The shaft 16 is made of a magnetic material and a magnetic field 17 is established between the magnetic seal 11 and the shaft 16. The bearing 12 is located adjacent an outer face of the developer housing 15. Magnetized carrier granules 14 are magnetically attracted to the magnetic seal 11 and form a barrier in the opening of the housing 15 surrounding the shaft 16.

If the bearing does not use grease, the lip seals may not be absolutely necessary. However, the magnetic seals are not completely effective in containing the toner or carrier. When vibrations and mechanical forces are present in the developer housing, the magnetic attraction of the beads to the magnet are not sufficient to overcome the vibrations and mechanical forces, and toner or carrier beads will pass through the seal.

As the journal rotates in the housing, the magnetic seals cooperating with the electrically conductive journal generate eddy currents that contribute to a heating problem. Further carrier beads collect around the outer edge and face of the magnetic seal where the magnetic field is weaker and frequently the magnetic attractive forces are insufficient to contain them on the seal and they migrate into the bearing causing bearing failure and requiring the beads to be replenished.

The magnetic seals and the bearings must be spaced far apart to prevent the carrier beads that collect in the wide magnetic field around the outer edge and face of the magnetic seal from entering the bearing. As the bearing is made of a magnetizable material, the magnetic seal could magnetize the bearing and draw the beads into the bearing if the seal is too close thereto. This spacing apart of the seals and bearings necessitates a longer shaft and wider developer housing adding cost and leading to more bulky copy machines.

As more compact copiers and printers are produced, the developer housings become smaller and the augers and rollers rotate more swiftly aggravating the aforementioned heating problem. Temperature rise within development bearings generally rises linearly with the speed of the shaft. Color printers and copiers which usually require a plurality of developer housings particularly use small developer housings and small swiftly rotating rollers and augers. Also as the printing market demands faster printers and copiers, the amount of power required run the machines increases with machine speed, thereby increasing the heat generated by the interfaces between the rotating and stationary components. To complicate the problems with heating in color printers and copiers, the smaller toners used in color copiers are more susceptible to agglomerates and streaking.

The heat from development bearings in development systems utilizing hybrid scavengeless development is particularly a concern. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al. U.S. Pat. No. 4,868,600 is incorporated herein by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. The lower melting point of color toners and the greater sensitivity of colors to streaking in the color application of HSD make the generation of heat from the development bearings particularly harmful. Furthermore, the agglomerates form toner fibers in HSD and collect on the electrode wires utilized to form the toner powder cloud. These toner fibers formed by heating the developer cause streaking to occur on the document and may damage the electrode wires. Also, the donor roll in HSD runs at much greater rotational speed than the magnetic rollers in magnetic brush development, the higher speed donor roll being a source of great heat.

The following disclosures may be relevant to various aspects of the present invention:

U.S. Pat. No. 5,287,148

Patentee: Sakemi et al.

Issue Date: Feb. 15, 1994

U.S. Pat. No. 5,267,007

Patentee: Watanabe et al.

Issue Date: Nov. 30, 1993

U.S. Pat. No. 5,177,536

Patentee: Watanabe et al.

Issue Date: Jan. 5, 1993

U.S. Pat. No. 4,878,088

Patentee: Nakanishi et al.

Issue Date: Oct. 31, 1989

U.S. Pat. No. 4,616,919

Patentee: Adley et al.

Issue Date: Oct. 14, 1986

U.S. Pat. No. 4,040,386

Patentee: Smith

Issue Date: Aug. 9, 1977

U.S. Pat. No. 3,788,275

Patentee: Hanson

Issue Date: Jan. 29, 1974

The relevant portions of the foregoing disclosures may be briefly summarized as follows:

U.S. Pat. No. 5,287,148 discloses a developing apparatus for developing electrostatic images. The apparatus includes a container for containing developer including magnetic material. A rotatable member is provided which is rotatable in the container in contact with the developer, the rotatable member being supported on bearings. A stationary magnetic member is disposed out of position inside the container and adjacent to the bearing with a clearance from the rotatable member. The stationary member encloses the rotatable member. The stationary member has first and second magnetic poles disposed adjacent to each other and having the same polarity to form a repelling magnetic field to form a magnetic brush of the developer in the clearance between the magnetic member and the rotatable member.

U.S. Pat. No. 5,267,007 discloses a developing apparatus having a rotatable member in contact with developer having magnetic particles in a container. The rotatable member is supported in the container by a bearing. A magnetic member encloses a portion of the rotatable member adjacent the bearing. The rotatable member includes a ferromagnetic material with a portion facing the magnetic material. The ferromagnetic material is magnetized by the magnetic member. A magnetic field is formed between the material and the member forming a magnetic brush of developer.

U.S. Pat. No. 5,177,536 discloses a developing apparatus having a rotatable carrying member which carries developer to the developing position. A magnet is disposed in the carrying member and includes magnets for conveying the developer. A magnetic member is disposed adjacent to the longitudinal end of the carrying member. The magnetic member is magnetized by the magnet and cooperates with the magnet to form a magnetic field forming a magnetic brush of developer in a gap between the magnetic member and the carrying member.

U.S. Pat. No. 4,878,088 discloses a developing unit of an electrophotographic apparatus for developing an electrostatic latent image formed on an image forming member, by electrostatically absorbing powder developer onto the latent image. The developing unit includes a screw provided with paddles or grooves, each having a helix angle with respect to an axis of the screw, the screw transferring and supplying the powder developer stored in a developer reservoir to the developing roller. The developing unit also includes a blade for regulating a layer thickness of the powder developer to be transferred to the image forming member and a flow regulating plate for biasing a flow of powder developer.

U.S. Pat. No. 4,616,919 discloses a sealing apparatus in a magnetic brush development device which is located in a non-contact fashion between the photoconductive drum and the magnetic brush roll. The seal has a plurality of ridges along the length of the seal that creates a differential air flow under the rotating photoconductive drum. This differential air flow prevents toner dust and bead carryout from axially migrating past the end of the photoconductive and magnetic roll.

U.S. Pat. No. 4,040,386 discloses an electrostatographic processor which has a development system which is equipped with a split housing and with retractable edge seals which may be moved toward and away from the imaging surface of the processor independently of the housing for the development system.

U.S. Pat. No. 3,788,275 discloses a device in which a magnetic flux field forms a shield of magnetic granules about a shaft member journaled for rotary movement. The shield is arranged to prevent contamination of the shaft member. Means for impelling the granules entrapped by the shield away from the bearing in the form of spiral grooves in a rotating member is also provided.

According to the present invention, there is provided a system for sealing a member rotating about an axis of a support. The system includes a magnetic field producing member and a magnetizable member. The magnetizable member is positioned adjacent the magnetic member. The magnetizable member has at least a portion thereof progressively increasing in thickness in a direction substantially parallel to the axis as distance from the axis increases.

According to the present invention, there is also provided a developer unit adapted to develop an electrostatic latent image. The developer unit includes a system for sealing a member rotating about an axis of a support. The system includes a magnetic field producing member and a magnetizable member. The magnetizable member is positioned adjacent the magnetic member. The magnetizable member has at least a portion thereof progressively increasing in thickness in a direction substantially parallel to the axis as distance from the axis increases.

According to the present invention, there is further provided an electrophotographic printing machine of the type having a developer unit adapted to develop an electrostatic latent image. The developer unit includes a system for sealing a member rotating about an axis of a support. The system includes a magnetic field producing member and a magnetizable member. The magnetizable member is positioned adjacent the magnetic member. The magnetizable member has at least a portion thereof progressively increasing in thickness in a direction substantially parallel to the axis as distance from the axis increases.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 5 printing machine will be shown hereinafter schematically and their operation described briefly with reference thereto.

Figure 5:
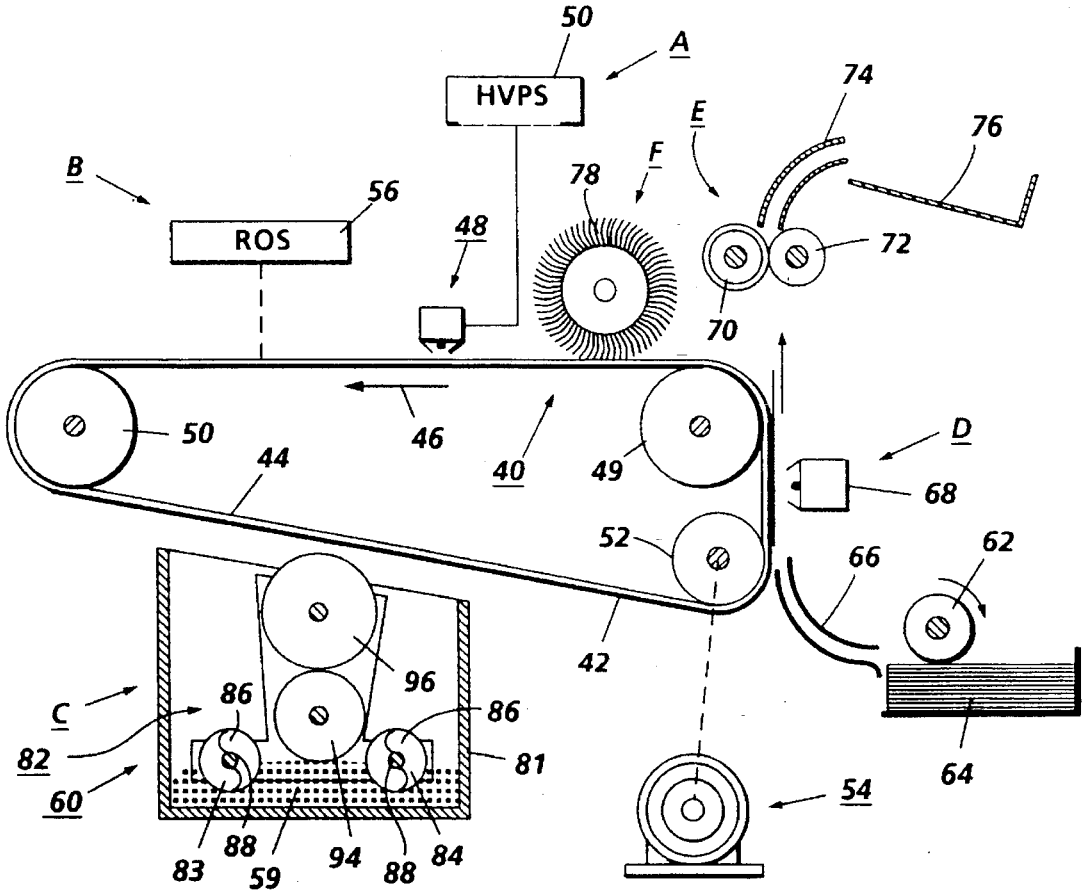
FIG. 5 is a schematic elevational view of an illustrative electrophotographic printing machine incorporating the magnetic seal with tapered shunts for the development housing of the present invention therein.

Referring initially to FIG. 5, there is shown an illustrative electrophotographic printing machine incorporating the development apparatus of the present invention therein. The printing machine incorporates a photoreceptor belt 40 in the form of a belt having a photoconductive surface layer 42 on an electroconductive substrate 44. Preferably the surface 42 is made from a selenium alloy. The substrate 44 is preferably made from an aluminum alloy or a suitable photosensitive organic compound. The substrate 44 is preferably made from a polyester film such as Mylar® (a trademark of Dupont (UK) Ltd.) which has been coated with a thin layer of aluminum alloy which is electrically grounded. The belt is driven by means of motor 54 along a path defined by rollers 49, 50 and 52, the direction of movement being counter-clockwise as viewed and as shown by arrow 46. Initially a portion of the belt 40 passes through a charge station A at which a corona generator 48 charges surface 42 to a relatively high, substantially uniform, potential. A high voltage power supply 50 is coupled to device 48.

Next, the charged portion of photoconductive surface 42 is advanced through exposure station B. At exposure station B, ROS 56 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 42, belt 40 advances the latent image to development station C as shown in FIG. 5. At development station C, a development system or developer unit 60, develops the latent image recorded on the photoconductive surface. The chamber in developer housing 81 stores a supply of developer material 59. The developer material 59 may be a two component developer material of at least magnetic carrier granules having toner particles adhering triboelectrically thereto. It should be appreciated that the developer material may likewise comprise a one component developer material consisting primarily of toner particles.

Again referring to FIG. 5, after the electrostatic latent image has been developed, belt 40 advances the developed image to transfer station D, at which a copy sheet 64 is advanced by roll 62 and guides 66 into contact with the developed image on belt 40. A corona generator 68 is used to spray ions on to the back of the sheet so as to attract the toner image from belt 40 to the sheet. As the belt turns around roller 49, the sheet is stripped therefrom with the toner image thereon.

After transfer, the sheet is advanced by a conveyor (not shown) to fusing station E. Fusing station E includes a heated fuser roller 70 and a back-up roller 72. The sheet passes between fuser roller 70 and back-up roller 72 with the toner powder image contacting fuser roller 70. In this way, the toner powder image is permanently affixed to the sheet. After fusing, the sheet advances through chute 74 to catch tray 76 for subsequent removal from the printing machine by the operator.

After the sheet is separated from photoconductive surface 42 of belt 40, the residual developer material adhering to photoconductive surface 42 is removed therefrom by a rotatably mounted fibrous brush 78 at cleaning station F in contact with photoconductive surface 42. Subsequent to cleaning, a discharge lamp (not shown) floods photoconductive surface 42 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
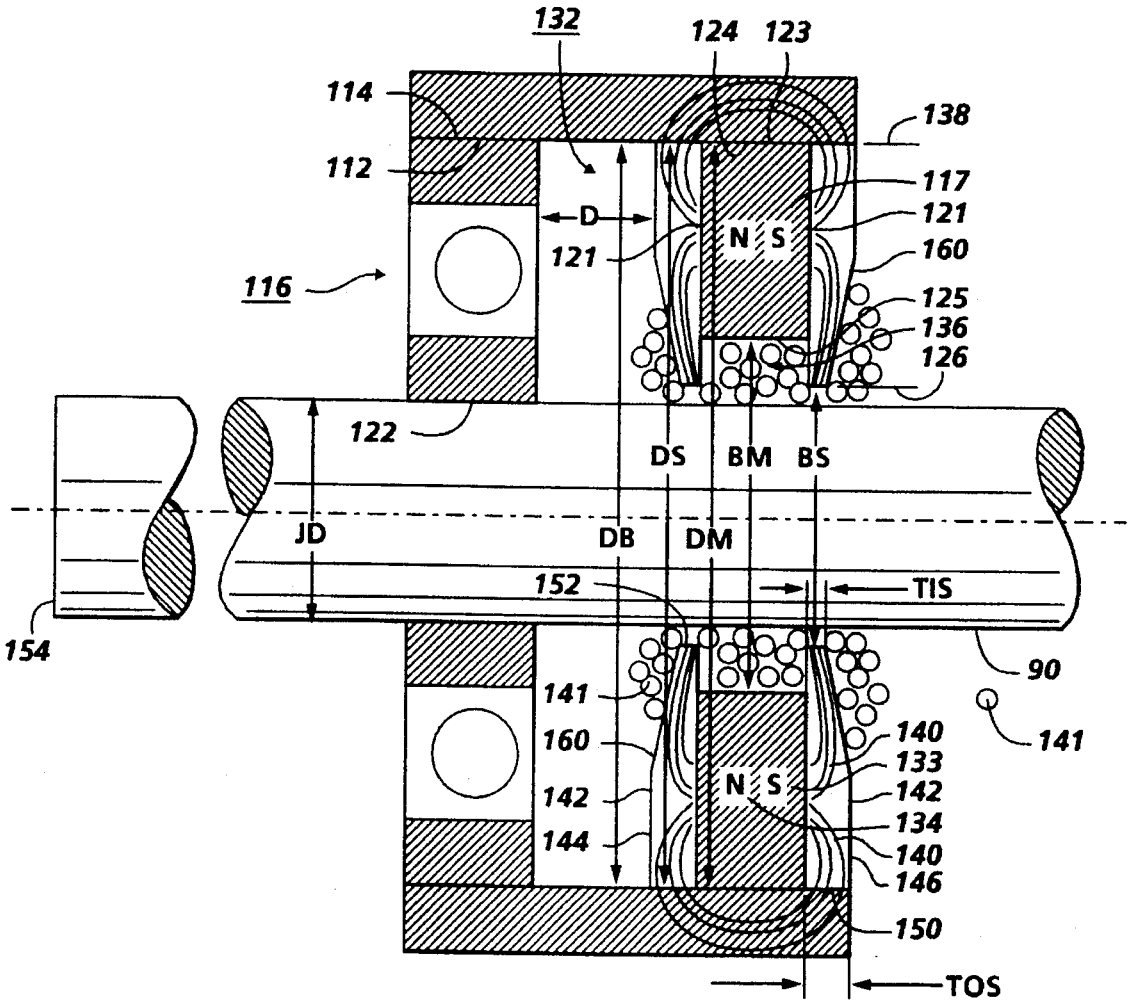
FIG. 1 is a partial sectional view of a magnetic seal with tapered shunts for a development housing according to the present invention.
Figure 2:
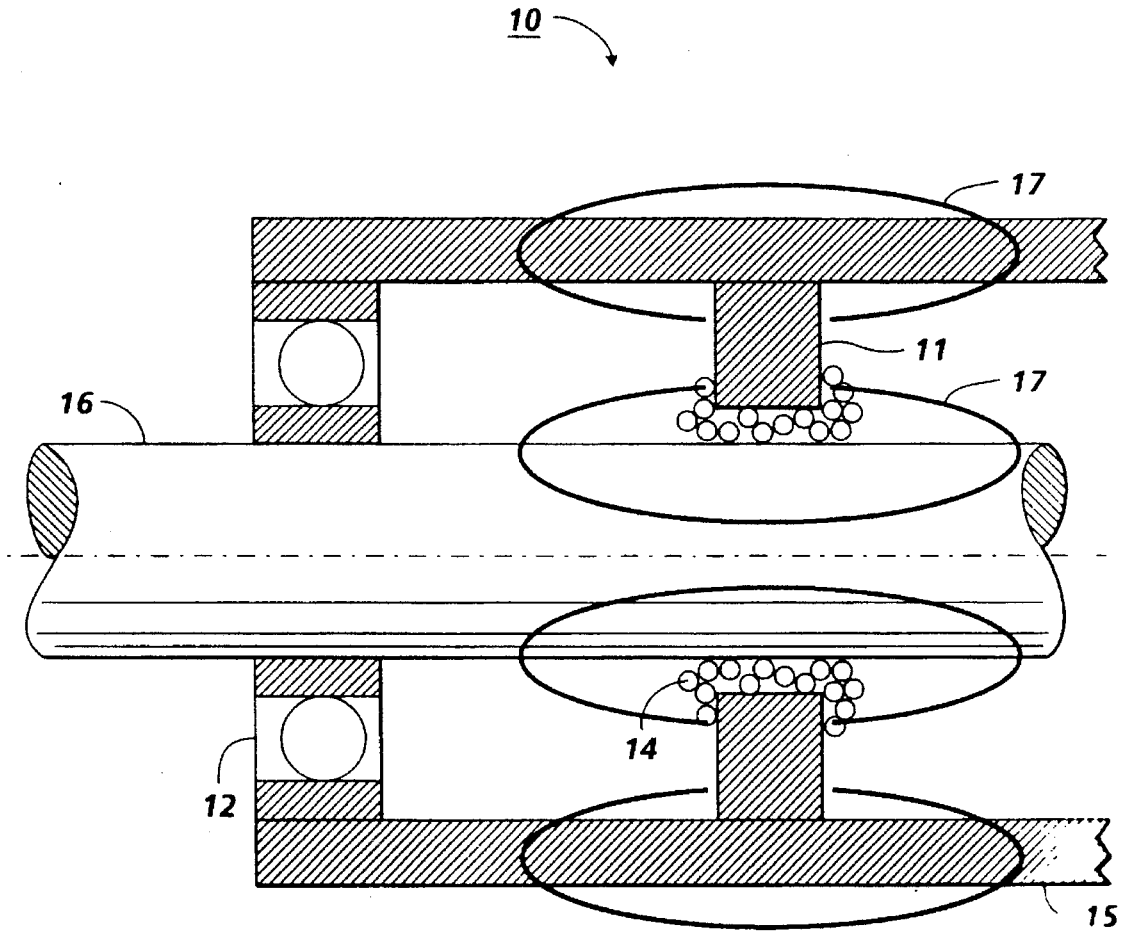
FIG. 2 PRIOR ART
FIG. 2 is a partial sectional view of a prior art seal configuration for a development housing.

According to the present invention and referring to FIG. 1, a magnetic developer seal 132 for sealing a shaft is shown incorporated into the developer unit 60 of FIG. 5. Referring to FIG. 5, developer housing 81 forms chamber 82 in which the developer material 59 is stored.

Referring again to FIG. 5, the developer material 59 is agitated and distributed by first and second augers 83 and 84, respectively, located in the chamber 82. The augers 83 and 84 may have any suitable shape, but typically, include spiral flights 86 (see FIG. 5) which extend from centrally located auger shafts 88. Transport roll 94 is also located in the chamber 82 and is used to transport developer material 59 to donor roll 96. The donor roll 96 is also located in the chamber 82 and is used to transport the developer material 59 to the photoconductive belt 40. Journals 90 (see FIG. 1) extend outwardly from the auger shaft 88, the transport roll 94 and the donor roll 96 and serve to support them.

The developer housing 81 can be made from any suitable durable material, such as a metal, durable plastic, or a composite material. For example, the developer housing 81 may be inexpensively made of molded plastic.

Referring again to FIG. 1, a bearing outer periphery 114 of a bearing 116 may either be slidably fitted within a bearing housing bore 112 or be interference fitted thereto depending upon the load on the journal 90. The bearing 116 may be any suitable durable bearing such as a rolling element bearing, a journal bearing, or a sleeve bearing. The bearing 116 may be a greased radial ball bearing with lip seals, but preferably, the bearing 116 is a shielded or low friction sealed bearing or an unsealed bearing. To minimize the cost of the bearing 116 and to provide a low friction bearing, the bearing 116 may be a sleeve bearing having a non-stick surface such as Teflon®, a trademark of DuPont (UK) Ltd. The sleeve bearing may include an internal ridge (not shown) to seal closely against the journal 90. The bearing 116 includes a bearing bore 122 to which the journal 90 matingly fits.

The journal 90 may merely extend through the bearing 116 or, as shown in FIG. 1, may have an end 154 which extends considerably beyond the bearing 116. A drive member (not shown), such as a gear may be matingly fitted to the journal 90 in the area outboard of the developer housing 81 and near the end 154 of the journal 90. The gear may be connected to a drive means (not shown) used to transmit torque to the journal 90.

Referring again to FIG. 1, the magnetic seal 132 according to the present invention is shown. The seal 132 is secured to the developer unit 60 by any suitable means such as by fasteners, adhesives or an interference fit therebetween. A seal housing bore 124 located in the housing 81 is generally concentric with the bearing housing bore 112. For example, the magnetic seal 132 may be securely fitted to the seal housing bore 124 at an outer periphery 138 of the seal 132 by an interference fit. The journal 90 fits through a seal bore 126 of the magnetic seal 132 and extends into the bearing bore 122 of the bearing 116. The magnetic seal 132 is used to seal the developer material 59 within the chamber 82 of FIG. 5. The seal 132 is spaced from the journal 90 with a space 136 being formed between the seal bore 126 of the seal 132 and the journal 90. The seal bore 126 seals against the journal 90.

The seal 132 is preferably made from a combination of permanent magnetic material and magnetizable material. It should be appreciated, however, that the seal 132 may alternatively be made of a magnetic or magnetizable material. A magnetic field 140 is formed in the space 136 between the seal bore 126 and the journal 90. The field 140 attracts a quantity of carrier granules 141 to the space 136 to form a curtain of carrier granules 141 that inhibit the progression of the developer material 59 through the space 136.

Referring again to FIG. 1, the magnetic seal 132 includes a body or magnet 117. The magnet 117 is preferably made from a permanent magnet, but it should be appreciated that the magnet 117 may alternately be made of permanent magnet particles embedded in a nonmagnetic binder, e.g., nylon. The magnet 117 may have any suitable shape, but preferably has a washer shape with flat parallel faces 121 and a magnet cylindrical outer periphery 123. The periphery 123 is concentric with a cylindrical bore 125 of the magnet 117. The magnet 117 has a left pole 133 and a right pole 134. The left and right poles 133 and 134, respectively, have opposite polarity, the left pole 133 being a south pole and the right pole being a north pole 134 or vice versa. The magnet 117 thus forms the magnetic field 140.

The seal 132 further includes shunts or magnetic field shapers 142. The shapers 142 may be made of any suitable magnetizable material. Ferrous material, for example, is particularly well suited for the use in the shapers 142. The shapers 142 preferably have a disc or washer shape.

Preferably, the shapers 142 include a first shaper 144 and a second shaper 146. The first shaper 144 is located against one of the faces 121 of the magnet 117, while the second shaper 146 is located against the other face 121 of the magnet 117. The magnet 117 is thereby sandwiched between the first shaper 144 and the second shaper 146.

Figure 4:
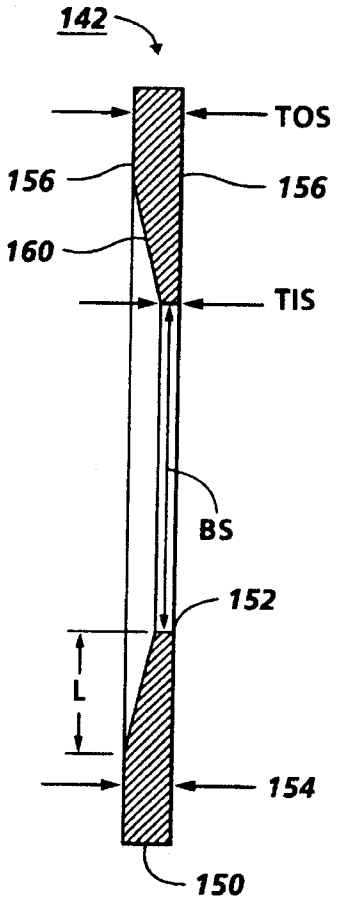
FIG. 4 is a cross sectional view of the tapered shunt of FIG. 3 along the line 4—4 in the direction of arrows.
Figure 3:
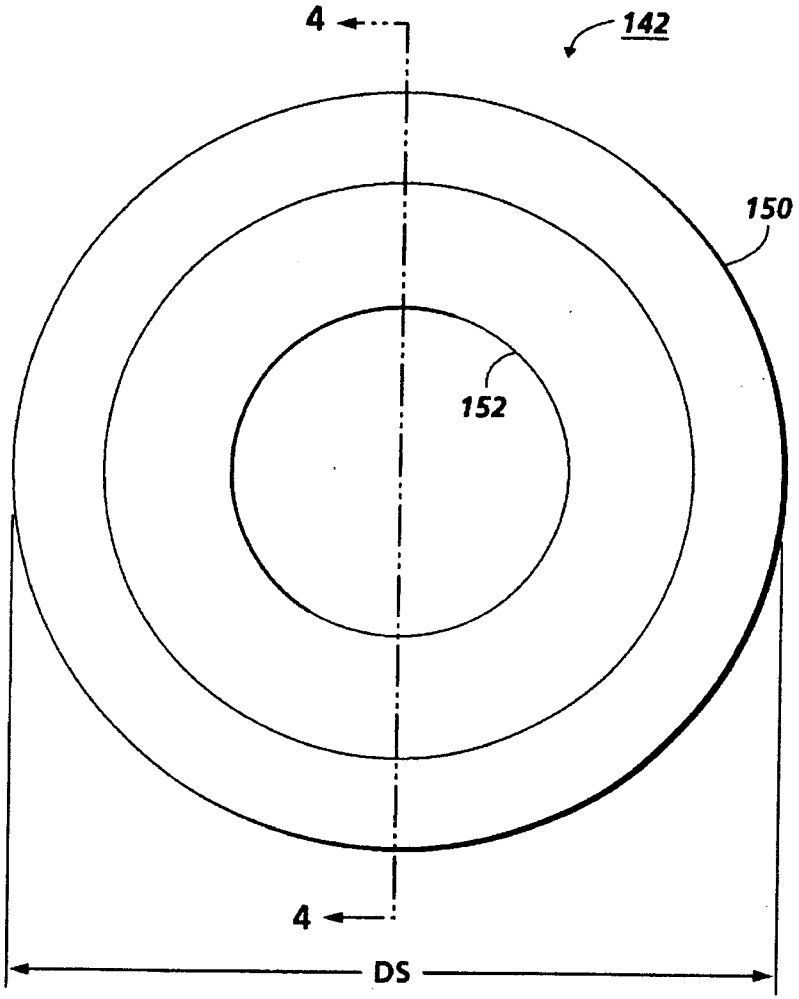
FIG. 3 is a plan view of a tapered shunt for use in a development housing.

The shaper 142 is shown in greater detail in FIGS. 3 and 4. The shaper 142 has a circular shaper periphery 150 which is concentric with a shaper cylindrical bore 152 of the shaper 142. The shaper 142 has a thickness 154 defined between parallel faces 156 of the shaper 142. To concentrate the magnetic field lines, the shaper 142 has a thickness TIS at the bore 152 which is less than a thickness TOS at the periphery 150. The thickness 154 of the shaper 142 may be reduced at the bore 152, with the thickness reduction being accomplished with face 156 of the shaper 142 having any appropriate shape. For example, as shown in FIGS. 3 and 4, the thickness 154 of the shaper 142 may remain constant for a portion of the shaper 142 and be reduced for a distance L radially along the shaper 142 with the shaper 142 having a chamfer 160. If the thickness TOS is twice the thickness TIS the improvement in sealing efficiency is significant. The applicants have found that a thickness TOS of 3 mm with a thickness TIS of 1 mm is effective for a journal 90 having a diameter of 12 mm. Preferably, the thickness TIS at the bore 152 is biased to one of the faces 156 of the shaper 142.

Referring again to FIG. 1, the shapers 142 are positioned with the thickness TIS at the bore 152 biased inwardly toward the magnet 117, the chamfers 160 pointing outwardly. This configuration concentrates the magnetic field 140 into a smaller area. Periphery 150 of the shaper 142 has a diameter DS which preferably is approximately equal to diameter DM of the magnet periphery 123. Preferably, the diameter DS of the shaper 142 and the diameter DM of the magnet 117 are approximately equal and slightly larger than diameter DB of the seal housing bore 124 to provide an interference fit between the magnet 117 and the housing 81 as well as between the shapers 142 and the housing 81. It should be appreciated, however, that only one of the shapers 142 or the magnet 117 need have the interference fit with the housing 81. Since the other members are magnetically attracted to each other, they would remain in their proper position. Preferably, the seal bore 126 is defined by the shaper bore 152, the magnet bore 125 being substantially larger than the shaper bore 152. Preferably, the shaper bore 152 has a shaper bore diameter BS which is approximately 0.10 inches larger than journal diameter JD of the journal 90. The magnet 117 has a magnet bore diameter BM of approximately 0.05 inches larger than the shaper bore diameter BS. The smaller shaper bore diameters BS provide for a concentrated magnetic field near the journal 90 while providing ample space 136 between the shapers 142 to trap the carrier granules 141.

The magnetic field 140 at the surface of the journal 90 must be strong enough to keep the carrier granules 141 suspended in the magnetic field to form the seal, yet weak enough to avoid having the carrier granules 141 score the journal surface and to avoid the generation of excessive heat from any currents generated between the rotating journal 90 and stationary magnetic seal 132. By providing the shapers 142 with shaper thickness TIS at the shaper bore 152 smaller than the shaper thickness TOS at the shaper periphery 150, the magnetic field 140 at the journal 90 may be highly concentrated. The concentration of the magnetic field 140 made possible by the shape of the shapers 142 permits distance D between the seal 132 and the bearing 116 to be minimized.

Since the shapers 142 shape the magnetic field 140 in the seal 132, the journal 90 is preferably made of a non-magnetically conductive material. Since the journal 90 requires ample strength and rigidity, the journal 90 is made of a strong non-magnetic material, such as stainless steel. Since the journal 90 is made of a non-magnetically conductive material, the carrier particles 141 tend to not accumulate along the journal 90, reducing the probability of carrier granules 141 entering the bearing 116.

While the invention may be practiced with the seal 132 of FIG. 1 having a solitary magnetic member 117, the invention may likewise be practiced utilizing a magnetic member having multiple poles. Such a configuration is shown in FIG. 6.

Figure 6:
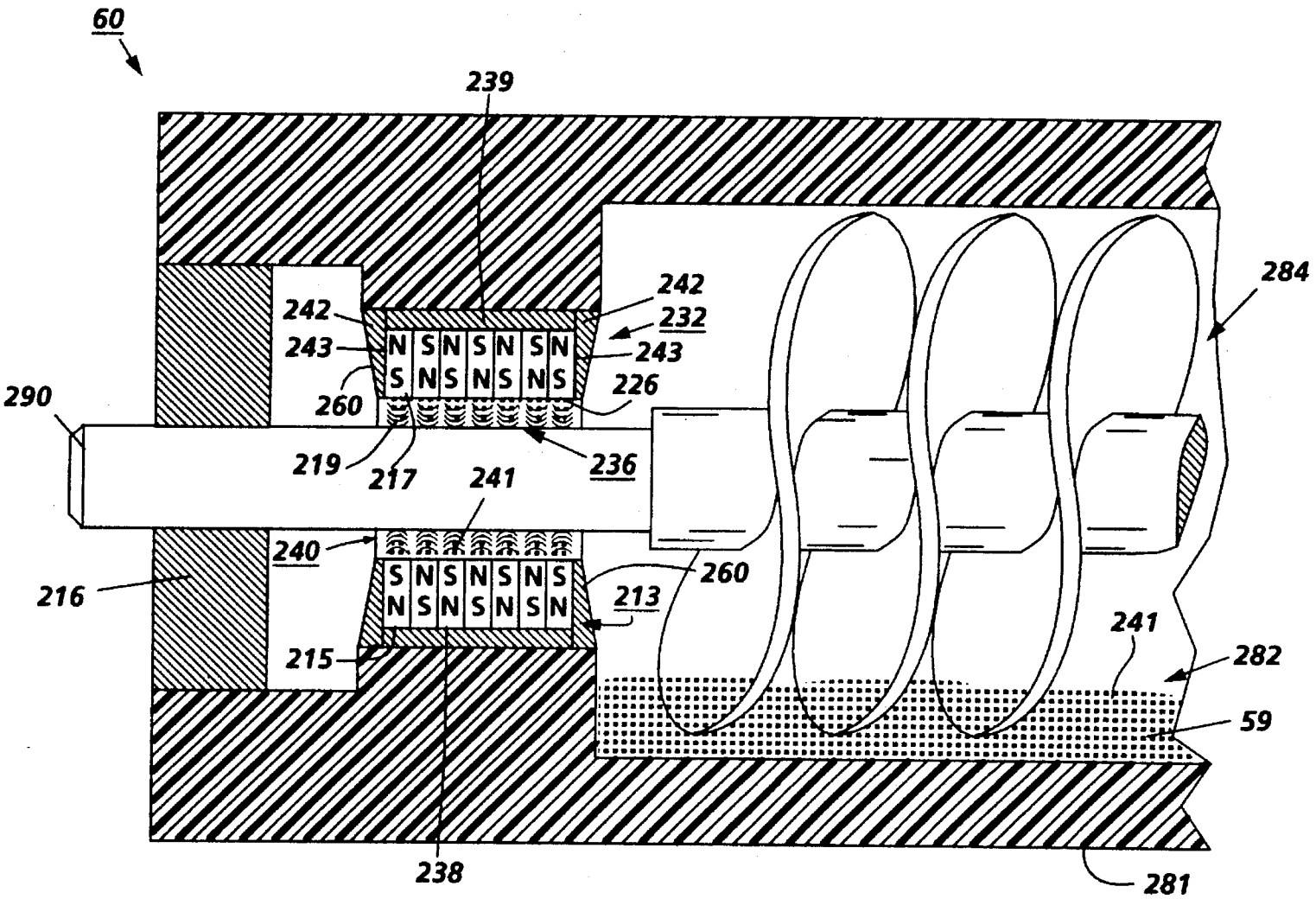
FIG. 6 is a partial sectional view of an alternate embodiment of a magnetic seal with tapered shunts and a flexible multi-pole magnet for a development housing according to the present invention.

Now referring to FIG. 6, another alternative embodiment of the invention is shown in seal 232 for sealing a shaft in the developer unit 60. Seal 232 is similar to seal 132 of FIG. 1, except that rather than having the seal 132 comprised of the solitary washer shaped outer magnet 117, the seal 232 is made of a flexible strip 213 which has seven (7) strip sections 215 therein each with a different polarity, which strip 213 is formed into a ring to make the seal 232.

A developer housing 281 defines a chamber 282 which contains a supply of the developer material 59. An auger 284 is used to transfer, agitate, and triboelectrically charge the developer material 59 within the chamber 282. Extending from an end of the auger 284 is a journal 290 which is used to support the auger 284. The auger journal 290 extends through a seal bore 226 in the seal 232. The seal 232 serves to prevent the migration of the developer material 59 from the chamber 282.

The developer seal 232 is preferably made from a magnetic or magnetizable material. A magnetic field 240 is formed in a space 236 between the seal bore 226 and the journal 290. The magnetic field 240 attracts a quantity of carrier granules 241 to the space 236 to form a curtain of carrier granules that inhibit the progression of the developer material 59 through the space 236. The seal 232 may include shunts or shapers 242 in the form of tapered magnetizable washers similar to shapers 142 of seal 132 of FIG. 1. The shapers 242 are located on faces 243 of the seal 232 to assist in directing the magnetic field 240. Like shapers 142 of FIG. 1 the shapers 242 include chamfers 260 to concentrate the magnetic field 240. The shunts may also include a magnetizable ring 239 fitted over a seal outer periphery 238.

The developer seal 232 includes more than one magnetic pole 217 along the length of the journal 290 in order that the magnetic field 240 includes more than one lobe 219. A plurality of lobes 219 serves to improve the efficiency of the seal 232 permitting the use of less expensive weaker magnets and permitting greater distances between the seal 232 and the journal 290. The greater distances and weaker magnets reduce the force required to rotate the journal and the resulting heat generated therefrom. Further, the use of weaker fields and greater distances reduces the eddy current generated between the journal 290 and the magnetic seal 232 and the resulting heat generated therefrom. Further, by providing a seal with multiple lobes 219, the magnetic field around the outer of faces 243 is less, thereby attracting fewer carrier granules 241 to the outside of the seal 232 which may lose their magnetic bond to the seal 232 and migrate to bearing 216 causing damage thereto.

The multi-pole developer seal 232 may be made of any suitable permanent magnet or permanent magnetic particles embedded in a non-magnetic binder, e.g. nylon. A number of the poles 217 greater than one may be used. The seal 232 is preferably made of a flexible magnetic strip which has seven (7) strip sections 215 which form the seven poles 217. The strip 213 is made of any suitable flexible magnetic or magnetizable material such as commercially available magnetic tape.

Figure 7B:
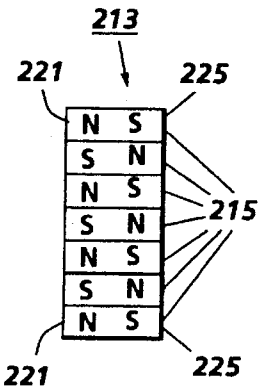
FIG. 7B is a plan view of a flexible multi-pole magnetic strip for use in a multi-pole magnetic seal.
Figure 7A:
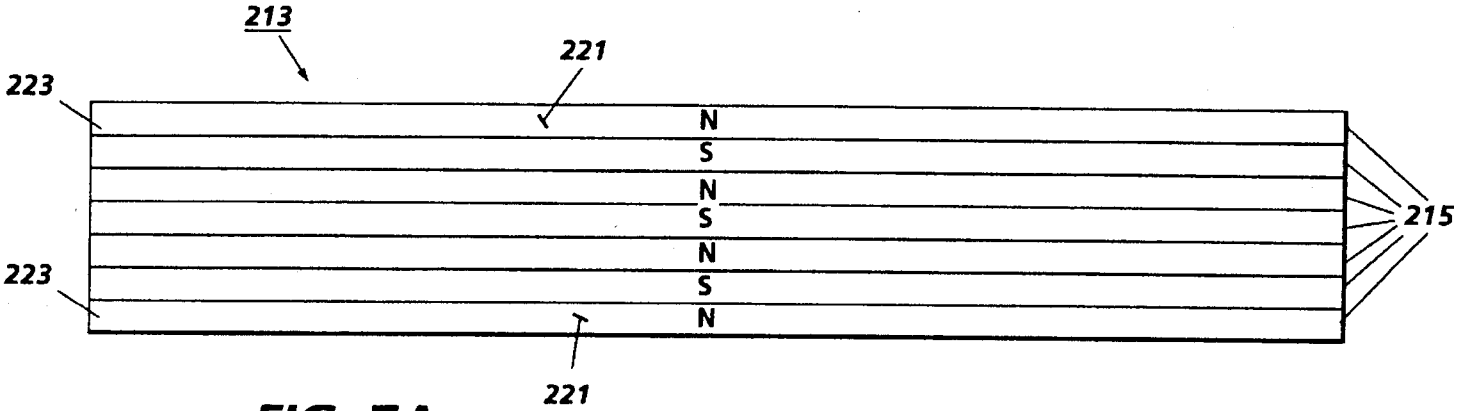
FIG. 7A is a top view of a flexible multi-pole magnetic strip for use in a multi-pole magnetic seal.
Figure 7C:
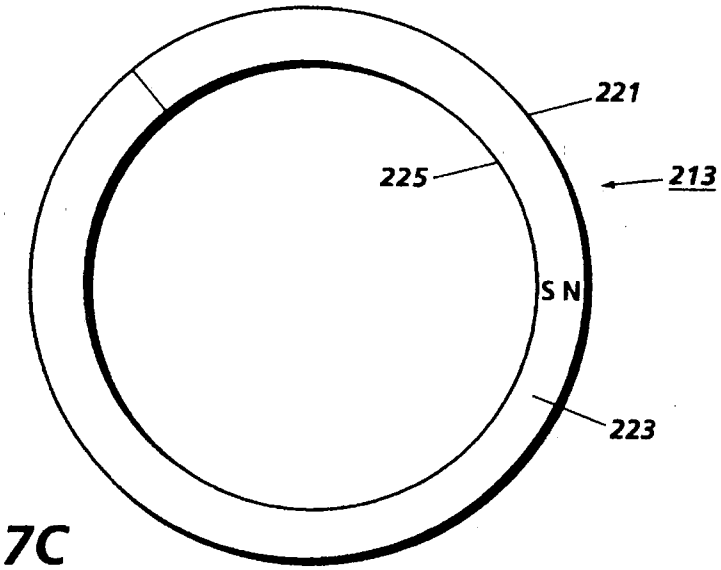
FIG. 7C is a plan view of a flexible multi-pole magnetic strip formed into a ring for use in a multi-pole magnetic seal.

Now referring to FIG. 7A, the strip 213 is shown in more detail. The strip 213 includes seven (7) strip sections 215. It should be appreciated that the invention may be practiced with as few as two sections. An outer face 221 of end strip sections 223 of the strip 213 has a north polarity, while an inner face 225 of the end strip sections 223 has a south polarity. Each face of each section 215 has a polarity opposite to that of the adjacent section. The arrangement of the polarities of the sections 215 is best shown referring to FIG. 7B. Referring to FIG. 7C the flexible strip 213 is shown formed into a ring shape with the polarities of the end strip sections 223 as shown.

Referring again to FIG. 6, the strip 213 is shown installed into the seal 232 with the polarities of the seven (7) strip sections 215 shown. The seven (7) sections 215 form the seven (7) poles 217 and the corresponding lobes 219.

Extending outboard of the seal 232 is the bearing 216 which is slidably fit to the auger journal 290. Preferably, as with the bearing 116 of FIG. 1, bearing 216 is a sleeve bearing.

The use of shunts having an inner thickness less than the outer thickness provides for a concentrated magnetic field which permits the placing of the magnetic seal more closely to the bearing.

The use of tapered shunts in conjunction with a non-magnetic shaft reduces the length of carrier chains around the shunts reducing the likelihood of carrier beads entering the bearing and reduces the necessity of bearing seals.

The use of tapered shunts with the tapered portions pointing inwardly provides for further concentration of the magnetic field thus improving the effectiveness of the magnetic seal.

The use of a magnetic seal with tapered shunts, with the shunts extending inwardly from the magnet provides for a further concentration of the magnetic field and a space for the formation of the developer seal between the magnet and the shaft.

The ability to reduce the size of developer units is particularly valuable for multi-color machines which have a multitude of developer units which must be placed adjacent the photoreceptive element.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A system for sealing a member rotating about an axis of a support, comprising:

a magnetic field producing member; and a magnetizable member positioned adjacent said magnetic field producing member, said magnetizable member having at least a portion thereof progressively increasing in thickness in a direction substantially parallel to the axis as distance from the axis increases.

2. A system as in claim 1, wherein the member comprises an elongated shaft.

3. A system as in claim 2, wherein said magnetic field producing member comprises a radially magnetized ring shaped member.

4. A system as in claim 3, wherein said ring shaped member is mounted on the support.

5. A system as in claim 3, further comprising a second ring shaped magnetizable member.

6. A system as in claim 5, wherein said magnetic field producing member is disposed between said first mentioned magnetizable member and said second ring shaped magnetizable member.

7. A system as in claim 6, wherein said first mentioned magnetizable member and said second ring shaped magnetizable member are closer to the shaft than said magnetic field producing member is to the shaft.

8. A system as in claim 6, wherein at least one of said first mentioned magnetizable member and said second ring shaped magnetizable member comprise a chamfer adjacent the shaft and opposed to the magnetic field producing member.

9. A system as in claim 1, wherein said magnetizable member increases in thickness by at least a factor of two.

10. A developer unit adapted to develop an electrostatic latent image, said developer unit of the type having a system for sealing a member rotating about an axis of a support, wherein the system comprises:

a magnetic field producing member; and a magnetizable member positioned adjacent said magnetic field producing member, said magnetizable member having at least a portion thereof progressively increasing in thickness in a direction substantially parallel to the axis as distance from the axis increases.

11. A developer unit as in claim 10, wherein the member comprises an elongated shaft.

12. A developer unit as in claim 11, wherein said magnetic field producing member comprises a radially magnetized ring shaped member.

13. A developer unit as in claim 12, wherein said ring shaped member is mounted on the support.

14. A developer unit as in claim 12, further comprising a second ring shaped magnetizable member.

15. A developer unit as in claim 14, wherein said magnetic field producing member is disposed between said first mentioned magnetizable member and said second ring shaped magnetizable member.

16. A developer unit as in claim 15, wherein said first mentioned magnetizable member and said second ring shaped magnetizable member are closer to the shaft than said magnetic field producing member is to the shaft.

17. A developer unit as in claim 15, wherein at least one of said first mentioned magnetizable member and said second ring shaped magnetizable member comprise a chamfer adjacent the shaft and opposed to the magnetic field producing member.

18. A developer unit as in claim 10, wherein said magnetizable member increases in thickness by at least a factor of two.

19. An electrophotographic printing machine of the type having a developer unit adapted to develop an electrostatic latent image, said developer unit of the type having a system for sealing a member rotating about an axis of a support, wherein the system comprises:

a magnetic field producing member; and a magnetizable member positioned adjacent said magnetic field producing member, said magnetizable member having at least a portion thereof progressively increasing in thickness in a direction substantially parallel to the axis as distance from the axis increases.

20. A printing machine as in claim 19, wherein the member comprises an elongated shaft.

21. A printing machine as in claim 20, wherein said magnetic field producing member comprises a radially magnetized ring shaped member.

22. A printing machine as in claim 21, wherein said ring shaped member is mounted on the support.

23. A printing machine as in claim 21, further comprising a second ring shaped magnetizable member.

24. A printing machine as in claim 23, wherein said magnetic field producing member is disposed between said first mentioned magnetizable member and said second ring shaped magnetizable member.

25. A printing machine as in claim 24, wherein said first mentioned magnetizable member and said second ring shaped magnetizable member are closer to the shaft than said magnetic field producing member is to the shaft.

26. A printing machine as in claim 24, wherein at least one of said first mentioned magnetizable member and said second ring shaped magnetizable member comprise a chamfer adjacent the shaft and opposed to the magnetic field producing member.

27. A printing machine as in claim 19, wherein said magnetizable member increases in thickness by at least a factor of two.

* * * * *